United States Patent [19]

Feathers

[11] Patent Number: 4,667,670

[45] Date of Patent: May 26, 1987

[54] GAS FLOW CONTROL VALVES

[75] Inventor: Leonard J. Feathers, Henfield, England

[73] Assignee: Racal Panorama Limited, Berkshire, England

[21] Appl. No.: 473,502

[22] Filed: Mar. 8, 1983

[30] Foreign Application Priority Data

Mar. 20, 1982 [GB] United Kingdom ..... 8208206

[51] Int. Cl.[4] ..... A62B 7/04

[52] U.S. Cl. ..... 128/204.26; 137/491; 137/908; 251/149.1

[58] Field of Search ..... 128/204.26, 204.27, 128/202.22, 205.24; 251/149.1, 149.3, 149.4, 149.6, 149.7; 137/491, 82, DIG. 9

[56] References Cited

U.S. PATENT DOCUMENTS

| | | | |
|---|---|---|---|
| 2,406,888 | 9/1946 | Meidenbauer, Jr. | 128/204.26 |
| 4,067,329 | 1/1978 | Winicki | 128/202.22 |
| 4,334,532 | 6/1982 | Jackson | 128/205.24 |
| 4,345,593 | 8/1982 | Sullivan | 128/204.26 |
| 4,361,145 | 11/1982 | Ekstrom et al. | 128/204.26 |

*Primary Examiner*—Henry J. Recla

*Attorney, Agent, or Firm*—Pollock, Vande Sande & Priddy

[57] ABSTRACT

In a demand valve for breathing apparatus gas flow is controlled by a main valve disc in accordance with the pressure in a control chamber. Gas vents from the control chamber through a bleed orifice at a rate dependent upon the deflection of a diaphragm sensitive to respiration and which controls the spacing of a spring arm from the bleed orifice. The arm has a set spacing from the orifice such as to provide "positive pressure" operation of the valve when the valve is connected into the inlet of an associated breathing mask. A lever on the valve contacts the mask inlet and acts through a pin to bias the arm to its "positive pressure" setting through a second spring arm. When the valve is disconnected the lever drops to allow the two arms to relax so that the first arm moves closer to the control chamber bleed orifice and thereby shuts off gas flow past the main valve disc.

9 Claims, 1 Drawing Figure

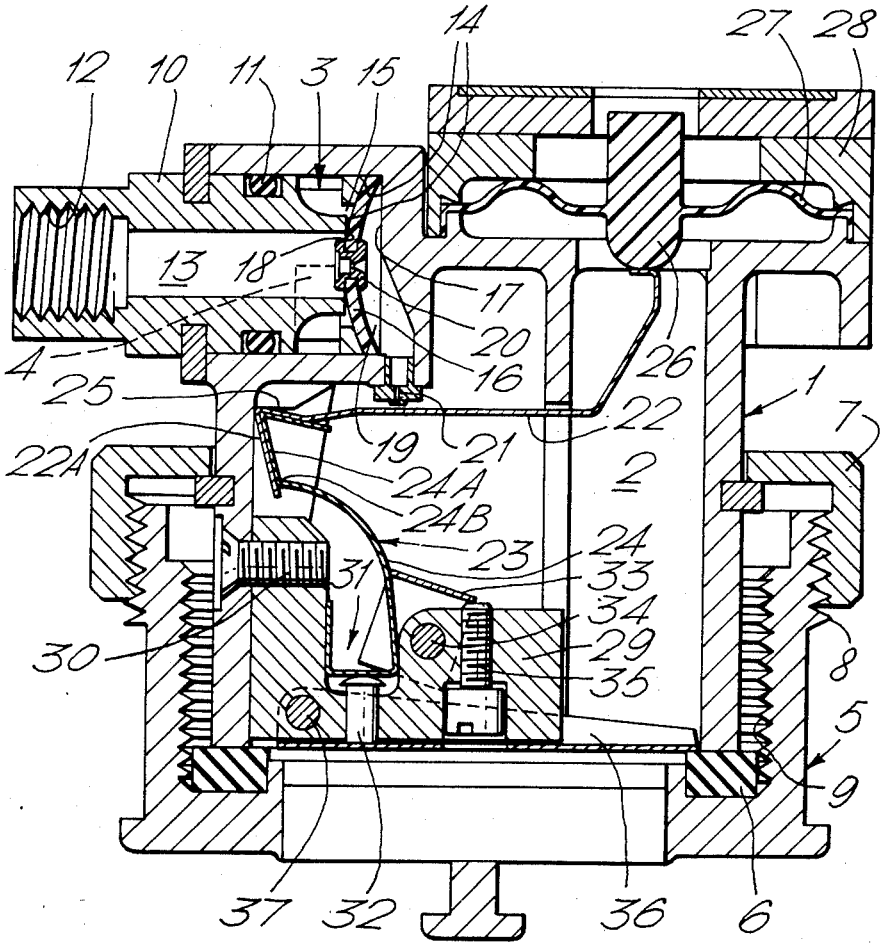
14
27
28
12
10
11
3
15
13
18
F
17
20
16
26
4
25
1
22
7
22A
19
21
2
24A
24B
23
24
31
33
34
29
35
30
8
5
9
37
32
36
6

GAS FLOW CONTROL VALVES

The present invention relates to gas flow control valves.

In a first aspect the invention is concerned with so-called lung-controlled or demand valves for use in breathing apparatus, and more particularly valves of the kind in which the main gas flow is regulated in accordance with the pressure established within a control chamber to which gas is substantially continuously supplied and from which gas is vented through a jet orifice at a rate dependent upon deflection of a pressure-responsive member sensitive to the respiration of the user, whereby the pressure within the control chamber, and accordingly flow of gas through the valve to the user, is dependent upon such deflection. A valve of this kind (referred to hereafter as "of the kind specified") is described in our published United Kingdom Patent Application No. 2054207A, where a pressure-responsive diaphragm is coupled to a separate, resilient control member a portion of which lies in the path of the jet of gas vented from the aforesaid control chamber, so that deflection of the diaphragm flexes the control member to vary its spacing from the jet orifice and thus change the control chamber pressure by its variable interaction with the gas jet.

It is recognised that a breathing apparatus which is intended to provide respiratory protection in toxic or otherwise inrrespirable environments should most desirably operate in a so-called "positive pressure" mode, that is to say where the demand valve of the apparatus is arranged to supply the breathing gas at a rate to maintain a super-ambient pressure within the face mask (or equivalent breathing interface means) throughout the respiratory cycle. Thus, the valve is set to open whenever the mask pressure which it senses falls below a certain elevated threshold value, (in contrast to conventional "negative pressure" operation which requires a sub-ambient pressure in the mask before the valve opens). This is to ensure that any leakage which may occur (e.g. from an imperfect face seal) can only be outwards from the system, so there is no risk that any ambient air will be breathed in under these conditions. The use of positive pressure breathing apparatus can, however, lead to certain procedural problems. In this respect it is standard practice for users of breathing apparatus to don their apparatus and turn on the breathing gas supply to check that the apparatus is functioning correctly in all respects, prior to entry into a hazardous zone, particular attention being paid to the sealing of the face mask edge to the user's face (typically performed with a pungent smoke source held in proximity to the sealing area). They may then have to stand by for a period before actually entering the zone. Especially in the case of self-contained breathing apparatus, which have a limited gas-storage capacity, it is undesirable that the supply of breathing gas should be needlessly depleted during such stand-by periods or at any other time when a breathing apparatus user does not actually require respiratory protection. In order to conserve the breathing gas supply in such circumstances, and as an alternative to shutting off the gas at source, the user of a negative pressure apparatus could temporarily disconnect the demand valve from his mask and breathe normally, the disconnected valve then sensing ambient pressure in place of the mask pressure and thus remaining closed. However, if the same was to be attempted with a demand valve set to operate in a positive pressure mode, the valve would respond to the sensed ambient pressure by opening fully and continuously, with the result that more gas would be wasted than by continuing to breathe with the apparatus intact.

In our above-mentioned Application No. 2054207A a demand valve set for positive pressure operation is equipped with a manually-operable device which is arranged to apply an additional spring bias to the diaphragm and control member of the valve at the selection of the user, to switch the valve to an 'OFF' condition notwithstanding that the sensed pressure is below the normal threshold value. The present invention, seeks in one aspect to provide a demand valve which, in use, is set automatically to a positive pressure mode of operation when connected to a facemask or equivalent, and which automatically switches to an 'OFF' condition when disconnected therefrom.

Broadly, therefore, in this aspect the invention resides in a demand valve adapted to control a main gas flow in response to sensed gas pressure and adapted for demountable connection to an inlet of a breathing interface means, including a mechanism adapted to apply a bias to the valve such that in a first position of that mechanism the valve provides a positive pressure mode of operation and in a second position of that mechanism the main gas flow is shut off if the valve senses ambient pressure, the said mechanism being engageable with the breathing interface means such that when the valve is connected as aforesaid the mechanism is constrained to be in its said first position and when the valve is disconnected the mechanism is adapted to move to its said second position.

More especially the invention resides in a demand valve of the kind specified adapted for demountable connection to an inlet of a breathing interface means, wherein the pressure-responsive member is coupled to a control member a portion of which lies in the path of the jet of gas vented from the control chamber, whereby in use of the valve deflection of the pressure-responsive member in response to respiration of the user moves the control member to vary the spacing of said portion thereof from the jet orifice thus to change the control chamber pressure by its variable interaction with the gas jet, the valve including a mechanism adapted to apply a variable force to the control member such that in a first position of that mechanism said portion of the control member is biased away from the jet orifice so as to provide a positive pressure mode of operation and in a second position of that mechanism said portion of the control member is biased further towards the jet orifice such that with the pressure-responsive member sensing ambient pressure the control chamber pressure is sufficient to prevent main gas flow through the valve, the said mechanism being engageable with the breathing interface means such that when the valve is connected as aforesaid the mechanism is constrained to be in its said first position and when the valve is disconnected the mechanism is adapted to move to its said second position.

In a preferred embodiment the control member is in the form of an essentially two-armed spring, (which may be a single-piece element or assembled from more than one piece), a first arm of which is coupled to the pressure-responsive member and provides that portion of the control member which lies in the path of the jet of gas vented from the control chamber, the said mechanism including a member which is arranged to engage variably with the second arm of the control member thereby to bias as aforesaid through the second arm said portion of the first arm of the control chamber.

In a second aspect the invention is concerned with a valve assembly which may be embodied in a demand valve of the kind specified to control the main gas flow in response to the pressure in the control chamber, but which may also be of more general utility in the field of pressure-responsive gas flow control. More particularly in this aspect the invention is concerned with a pressure-responsive valve assembly of the kind comprising a flexible valve disc bounded on one side (herein called the front side) by means providing a face against which the disc is adapted to seat and through which there opens a central gas inlet and one or more gas outlets radially outwards of the gas inlet, the disc being bounded on its other side (herein called the reverse side) by a control chamber, and an orifice being provided in the disc through which gas can bleed from the said inlet to the control chamber. In use of such a valve assembly the disc reacts to the difference in thrust generated by the gas inlet pressure acting on its front side (over the cross-sectional area of the inlet) and by the control chamber pressure acting on its reverse side (the latter being established by the gas bleed through said orifice and such other pressure-control means as may be provided). While the thrust on the reverse side of the disc exceeds that on its front side the disc remains seated on the said face to isolate the gas outlet(s) from the inlet. A sufficient drop in the control chamber pressure to decrease the reverse-side thrust below that acting on the front side, however, flexes the disc away from its seat to provide corresponding gas flow from the inlet to the outlet(s).

It is vital to the proper operation of such a valve assembly that gas should not leak from one side of the disc to the other except by means of the orifice provided for that purpose; the valve disc must therefore provide a reliable gas-tight seal at its periphery throughout the service life of the assembly. At the same time it is desirable to employ a flat valve disc without complex sealing formations at its periphery, both for simplicity in manufacture and to ensure close control of its flexural properties. Accordingly this aspect of the invention proposes a valve assembly incorporating a flat valve disc which is made with a diameter slightly greater than that of the surrounding valve structure against which the periphery of the disc is adapted to seal, so that the disc is self-stressing to press against that structure when assembled, the disc thereby adopting a bowed form with the convex side thereof towards the face through which the gas inlet and outlet(s) open, and the said face being correspondingly dished to provide a seat for the bowed valve disc.

Those and other aspects of the present invention will now be more particularly described, by way of example, with reference to the accompanying drawing which is a sectional side elevation of a demand valve as connected into the inlet of a breathing apparatus facemask.

Referring to the drawing, the valve has a moulded-plastics body 1 providing a main cylindrical cavity 2, which defines the outlet chamber of the valve through which breathing gas is supplied to the facemask, and a smaller cylindrical cavity 3 perpendicularly offset from the cavity 2. Ports 4 are provided through the wall which separates the two cavities, for gas flow as will be described below. The valve is connected into the tubular inlet fitting 5 of a facemask, with the outer end face of the chamber 2 pressed against a ring seal 6 in the fitting. The valve is fixed by means of a threaded ring 7 captive on the body 1 and screwed onto an external thread 8 of the inlet fitting, in the illustrated embodiment the fitting 5 also having an internal thread 9 for the alternative connection of a standard respirator (filter) cartridge.

An insert 10 is retained in the cavity 3 with a gas-tight seal provided by an 0-ring 11, the outer end of this insert providing a union 12 for connection to a hose (not shown) which leads air at a regulated pressure of, say, 9 bars to the valve from an associated high pressure cylinder and firststage pressure-reducer. Air supplied to the union 12 enters a central inlet passage 13 of the insert 10 terminating at the inner end face 14 of the insert. An annular outlet port 15 surrounds the passage 13 at this end of the insert and likewise opens through the face 14, the port 15 also being in permanent communication with the ports 4. Admission of air from the passage 13 to the port 15 (and thence via the ports 4 and chamber 2 to the facemask), is controlled by an elastomeric valve disc 16 retained between the insert 10 and the inner cnd face 17 of the cavity 3.

The element 16 is moulded as a flat disc with a diameter slightly greater than the internal diameter of the cavity 3. Consequently, when the disc is assembled into the cavity it is stressed to press out radially against the surrounding surface of the cavity, thereby to provide a reliable gas-tight seal at the periphery of the disc, and adopts a bowed form as indicated in the drawing. The proximity of the end face 17 of the cavity 3 to the disc 16 in the assembled state ensures that the disc must bow with its convex side towards the face 14 of the insert 10 which, as shown, is correspondingly dished to receive the bowed disc. More particularly, the portion of the face 14 radially outwards of the port 15 has a complementary profile to the corresponding portion of the disc 16 to provide a snug support for the disc in its seated condition, while the portion of the face 14 between the passage 13 and port 15 is machined flat to define a sealing edge 18 with which the disc 16 engages when seated to isolate the port 15 from the passage 13.

Flexure of the disc 16 away from its illustrated seated position to provide communication between the passage 13 and port 15 is dependant upon variation of a control pressure established in a small chamber 19 existing between the disc and the inner end of the cavity 3. More particularly, the disc 16 responds to the difference in thrust generated by the pressure of the air supplied to passage 13 acting over the central region of the front side of the disc, and by the control pressure within the chamber 19 acting over the full area of the reverse side of the disc.

The pressure within chamber 19 is established by the continuous bleed of air into that chamber from the passage 13 through an orifice in a spool 20 held in the disc, and the continuous venting of air from that chamber into chamber 2, at a variable rate, through a jet orifice 21. In the latter respect, an arm 22 of an essentially two-armed spring member 23 lies in the path of the jet of air escaping from the orifice 21 such that pressure build-up in the chamber 19 varies in dependence upon movement of the arm 22 towards or away from the orifice 21. When the spacing of the arm from the orifice is decreased, the rate of venting of air from the chamber 19 is decreased by the interaction of the arm with the air jet and the back pressure acting in the chamber 19 on the disc 16 increases and so reduces, or blocks entirely, the main flow of gas past the disc 16 and into the chamber 2 from the ports 4. Increase of that spacing, on the other hand, relieves the pressure in the chamber 19 by increasing the rate of venting via the orifice 21, so enabling or increasing flow of gas past the disc 16. At no time, however, does the arm 22 come into mechanical contact with, or entirely seal off the flow through, the orifice 21.

The spring member 23 in this embodiment is of two-piece construction, comprising a strip of, say, 0.3 mm thick stainless steel defining the arm 22 and a strip of, say, 0.125 mm thick beryllium copper defining the other arm 24. The two arms have respective 'V' formations 22A and 24A which nest within one another with the 'V' of the arm 24 having a greater included angle as manufactured in order to ensure a tight fit within the corresponding formation of arm 22. The arm 24 presses the apex of the 'V' 22A into a corner defined between the side wall of chamber 2 and an adjacent internal shoulder 25, to define a pivot point for the arm 22. The free end of the arm 22 is in abutment with the thicknened central region 26 of an elastomeric diaphragm 27. This diaphragm is clamped to the body 1 around its periphery by an external collar 28, to respond to the difference between the pressure in the chamber 2 and the ambient pressure to which the diaphragm is exposed on its side remote from the chamber 2. Reduction of the pressure within the chamber 2 during inhalation by a user draws the diaphragm inwards to pivot the arm 22 away from the orifice 21 so that air is supplied through the ports 4 to the chamber 2 and the user as previously described. Build up of pressure in the chamber at the termination of inhalation and during exhalation (the facemask includes a separate exhalation valve, not shown, for venting exhaled gas) deflects the diaphragm outwards and allows the arm 22 to pivot back towards the orifice 21, to decrease or shut-off the flow through ports 4, under the inherent bias of the spring member.

The spacing of the arm 22 from the orifice 21 is initially set, under specified test conditions, so as to achieve a so-called "positive-pressure" mode of operation for all appropriate breathing rates. This setting is achieved through an adjustment mechanism now to be described.

The spring arm 24 is bowed away from the 'V' portion 24A and held at its free end in a mounting block 29 which is secured to the body 1 by a screw 30 and extends diametrally part-way across the chamber 2. More particularly the end of the arm 24 is received in a slot 31 in the block 29 and presses therein upon the head of a pin 32. Although, as described below, the pin 32 is capable of sliding movement relative to the block 29, in normal operation with the valve connected to the facemask the pin remains in a fixed position. Intermediate the 'V' 24A and the pin 32 an adjusting member 33 bears upon the convex side of the arm 24. The member 33 is of channel section with the web of the channel engaging the arm 24 and its flanges straddling the block 29, where they are journalled on a pin 34. A set screw 35 extends through the block 29 and engages the web of the member 33 such that by turning the screw in either sense the adjusting member is pivoted to bear on the spring arm 24 with greater or less force as appropriate. Increasing the force with which it so bears flexes the bowed portion of the arm 24 so as to move the junction point 24B between the bowed portion and the 'V' 24A to the left as viewed in the drawing, thereby pivoting the arm 22 clockwise to increase its spacing from the orifice 21; slackening the force of the adjusting member on the arm 24 has the converse effect.

The pin 32 referred to above, is slidable in a bore in the block 29 and is engaged at its foot end by the web of a channel-sectioned lever 36, the flanges of which straddle the block 29 and are journalled on a pin 37. When the valve is connected into the inlet 5 the free end of the lever 36 engages the sealing ring 6 to pivot the lever into the position shown, in which the pin 32 is pressed by the lever web against the spring arm 24. If the valve is withdrawn from the inlet 5, however, it is free to pivot clockwise (as viewed in the drawing) to a small degree, thereby relaxing the force of the pin 32 on the arm 24. This in turn allows the bowed portion of the arm 24 to relax to the extent that the arm 22 is pivoted anticlockwise, close to the orifice 21. By this means it is provided that the valve disc 16 is seated to shut off the main gas flow through the valve, even though by disconnecting the valve from the inlet 5 the chamber 2 is exposed to ambient pressure which, if occurring during "positive pressure" operation, would normally cause the valve to open fully. Disconnection of the demand valve, therefore, automatically switches it to an "OFF" mode to conserve the air supply without having to turn off the supply at source (e.g. with a main shut-off valve on the storage cylinder). Reconnection of the valve will move the lever 36 and pin 32 back to the working poition to re-stress the spring arm 24 and thereby automatically switch the valve back into its positive pressure mode.

As described above there is only a "one-way" coupling between the diaphragm 27 and the arm 22 brought about by the abutment of the diaphragm portion 26 with the end of the arm, so that movement of the arm in the flow-reducing direction is under the control of its own spring bias and not directly under the control of the diaphragm. This is of advantage in minimising "bounce" in the arm 22 when the diaphragm deflects outwardly and in avoiding any risk of the arm being drawn by the diaphragm into abutment with the orifice 21, with consequent risk of damage to the arm, in the event of any overpressure in the chamber 2. However, in other embodiments a positive "two-way" coupling may be more appropriate.

I claim:

1. A demand valve comprising a housing with an inlet adapted to be connected to a source of breathing gas and an outlet with means adapted for demountable connection of said outlet to an inlet opening of a breathing interface means; valve means adapted to control a main gas flow from said inlet to said outlet; pressure sensing means in said housing for sensing pressure variations caused by the respiration of a user of said breathing interface means; said valve means being operatively associated with said pressure sensing means for controlling said main gas flow in response to said pressure variations; biasing means adapted to apply a bias to said valve means constructed and arranged such that in a first position of said biasing means said valve means provides a positive pressure mode of operation and in a second position of said biasing means said main gas flow is shut off if said pressure sensing means senses pressure in said housing equal to or greater than an ambient pressure; and means associated with said outlet of said housing for actuating said biasing means, said actuating means being engageable with the inlet opening of said breathing interface means such that when said outlet is connected to said breathing interface means, said biasing means is constrained to be in its first position and when said outlet is disconnected, said biasing means is adapted to move to its said second position.

2. A demand valve according to claim 1, wherein said actuating means includes a feeler movably mounted in said housing which is constrained in a first position to engage said biasing means when said outlet is connected to said breathing interface means and is freely movable to a second position when said outlet is disconnected.

3. A demand valve according to claim 1, wherein said housing comprises an internal chamber in communication with said inlet and said outlet of the housing, said pressure sensing means being mounted in said internal chamber for sensing the pressure prevailing in said internal chamber.

4. A demand valve comprising a housing with an inlet adapted to be connected to a source of breathing gas and an outlet with means adapted for demountable connection of said outlet to an inlet of a breathing interface means; means defining a control chamber in said housing; main valve means responsive to pressure in said control chamber for regulating main gas flow from said inlet to said outlet in accordance with the pressure established in said control chamber; means for the continuous provision of gas flow to said control chamber; an orifice extending between said control chamber and said outlet and through which a jet of gas vents from said control chamber; pressure-responsive means in fluidic communication with said outlet and deflectable in response to respiration of the user; a control member coupled to said pressure-responsive means a portion of which overlaps said orifice and lies in the path of the jet of gas vented from the control chamber to define a space therebetween, whereby in use of the demand valve deflection of the pressure-responsive means in response to respiration of the user moves the control member to vary the spacing of said portion thereof from the jet orifice and accordingly vary the rate of gas venting from said control chamber, thus to change the control chamber pressure by its variable interaction with the gas jet; biasing means adapted to apply a variable biasing force to said control member in a first position such that said portion of the control member is biased away from the jet orifice so as to provide a positive pressure mode of operation for the demand valve and in a second position such that said portion of the control member is biased further towards the jet orifice and, with the pressure-responsive means sensing pressure equal to or greater than ambient pressure, the control chamber pressure is sufficient to prevent main gas flow through the main valve means; and said outlet including means engagable with the inlet of said breathing interface means such that when said outlet is connected to said breathing interface means said biasing means is constrained to be in its said first position and when said outlet is disconnected, said biasing means is adapted to move to its said second position.

5. A valve according to claim 4 wherein said control member is in the form of an essentially two-armed spring, a first arm of which is coupled to the pressure-responsive means and provides that portion of the control member which lies in the path of the jet of gas vented from the control chamber, said biasing means including a biasing member which is arranged to engage variably with the second arm of the control member thereby to bias as aforesaid through the second arm said portion of the first arm of the control member.

6. A valve according to claim 5 wherein said biasing member is pressed against the second arm of the control member when said biasing means is in its first position and is released from the control member when said biasing means is in its second position.

7. In combination with a respirator mask having an inlet opening, a coupling connection comprising a housing with an inlet adapted to be connected to a source of breathing gas and an outlet with means adapted for demountable connection to said inlet opening of said respirator mask; valve means adapted to control a main gas flow from said inlet to said outlet; pressure sensing means in said housing for sensing pressure variations caused by the respiration of a user of said respirator mask; said valve means being operatively associated with said pressure sensing means for controlling said main gas flow in response to said pressure variations; biasing means adapted to apply a bias to said valve means constructed and arranged such that in a first position of said biasing means said valve means provides an over-pressure mode of operation and in a second position of said biasing means said main gas flow is shut off if said pressure sensing means senses pressure in said housing equal to or greater than an ambient pressure; and means associated with said outlet of said housing for actuating said biasing means, said actuating means being engageable with the inlet opening of said respirator mask such that when said outlet is connected to said inlet opening, said biasing means is constrained to be in its first position and when said outlet is disconnected, said biasing means is adapted to move to its said second position.

8. A connector according to claim 7, wherein said actuating means includes a feeler movably mounted in said housing which is constrained in a first position to engage said biasing means when said outlet is connected to said inlet opening and is freely movable to a second position when said outlet is disconnected.

9. A connector according to claim 7, wherein said housing comprises an internal chamber in communication with said inlet and said outlet of the housing, said pressure sensing means being mounted in said internal chamber for sensing the pressure prevailing in said internal chamber.

* * * * *